United States Patent [19]

Schrödl

[11] Patent Number: 4,714,207

[45] Date of Patent: Dec. 22, 1987

[54] IMPACT BAR FOR A COMMINUTING ROTOR

[75] Inventor: Hermann Schrödl, Gallspach, Austria

[73] Assignee: Fried. Krupp Gesellschaft mit beschränkter Haftung, Essen, Fed. Rep. of Germany

[21] Appl. No.: 886,441

[22] Filed: Jul. 17, 1986

[30] Foreign Application Priority Data

Jul. 17, 1985 [DE] Fed. Rep. of Germany ..... 3525442

[51] Int. Cl.[4] ..... B02C 13/28

[52] U.S. Cl. ..... 241/189 R; 241/195; 241/291

[58] Field of Search ..... 241/189 R, 195, 197, 241/189 A, 291

[56] References Cited

U.S. PATENT DOCUMENTS 2,747,803 5/1956 Hanse et al. .
3,608,841 9/1971 Wageneder et al. ..... 241/195 X
3,929,296 12/1975 Stoeber ..... 241/197
4,373,678 2/1983 Reitter .

FOREIGN PATENT DOCUMENTS 930839 7/1955 Fed. Rep. of Germany .
1537209 7/1968 France .

*Primary Examiner*—Timothy V. Eley
*Attorney, Agent, or Firm*—Spencer & Frank

[57] ABSTRACT

An impact bar - adapted to assume an installed state in which it is mounted in a rotor of a comminuting machine - has a length extending generally radially as viewed relative to the rotary axis, a leading side and a trailing side as viewed relative to a direction of rotation, and a cross-sectional area taken along a sectional plane extending parallel to a plane of rotation. The cross-sectional area is curved in a generally C shape open towards the leading side and is symmetrical relative to a symmetry plane being generally perpendicular to the bar length. The cross-sectional area has a constriction lying in the symmetry plane. The trailing side is adapted to be supported against tangential forces at a location situated radially outwardly of the constriction as viewed relative to the rotary axis. The constriction is formed by a first and a second groove at the leading and trailing side. Each groove is cross-sectionally symmetrical to the symmetry plane and each has a groove bottom and lateral groove flanks constituting holding faces for taking up generally radially oriented forces.

18 Claims, 4 Drawing Figures

FIG.1
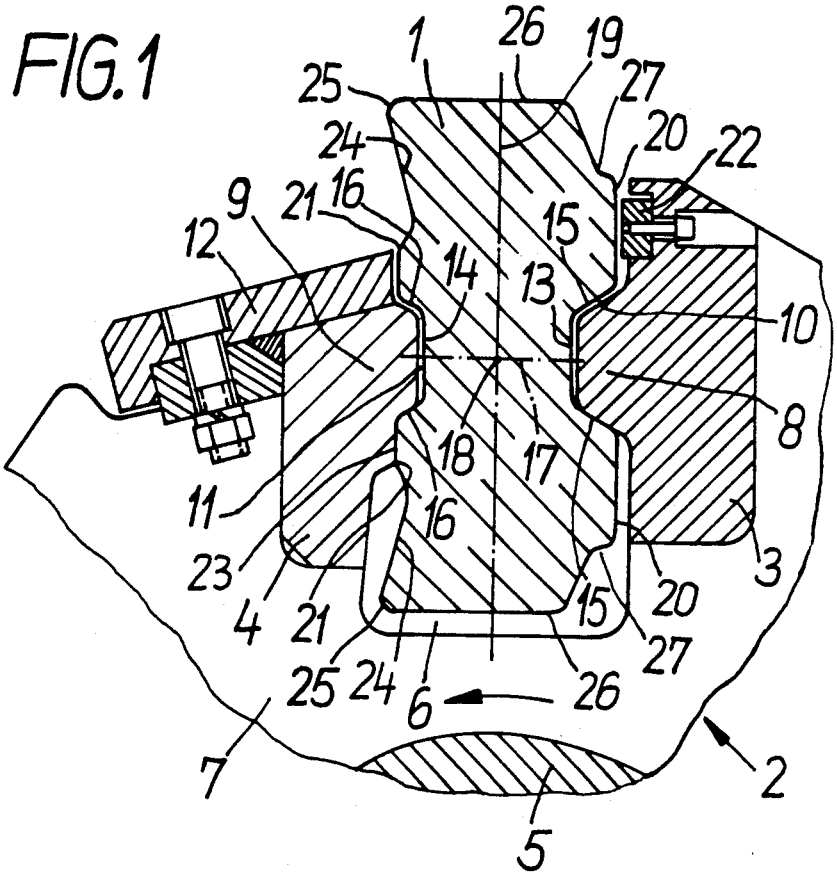
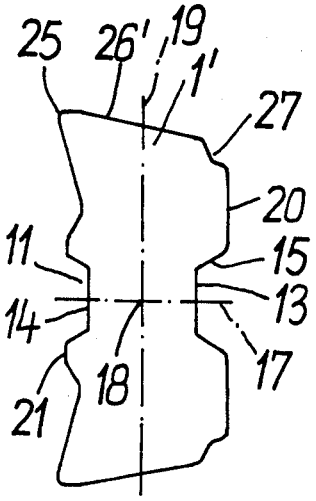
FIG.2
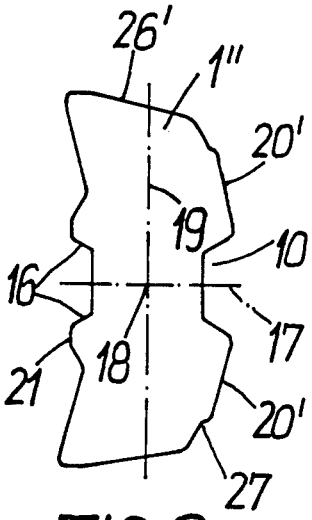
FIG.3
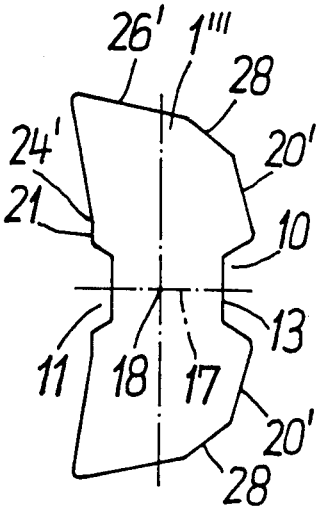
FIG.4

IMPACT BAR FOR A COMMINUTING ROTOR

BACKGROUND OF THE INVENTION

This invention relates to an impact bar securable to the rotor of an impact crusher or similar comminuting machine. The impact bar has a length measured in a direction generally radially to the rotor. The shape of the cross section of the bar taken along a plane parallel to the plane of rotation of the rotor is bent symmetrically in the length dimension of the bar in an approximately C-shape whose opening is at the front or leading side of the impact bar as viewed in the direction of rotation. The impact bar has a constriction in its symmetry plane, and the reverse side (trailing side) of the bar is adapted to be supported against tangential forces radially outwardly of the constriction.

An impact bar of the above-outlined type is known and is disclosed, for example, in German Pat. No. 930,839. The impact bar described therein has a cross-sectionally C-shaped or V-shaped configuration by virtue of the fact that it has, on its leading side as viewed in the direction of rotation of the rotor on which it is installed, a longitudinally extending recess or notch of obtuse angle. The impact bar is tightened to the rotor by special clamping pieces projecting into the recess and engaging the deepest location of the recess which, at the same time, constitutes the constriction for the impact bar. The rotor is designed such that during work the impact bar is with its planar reverse side - as related to the rotor axis - backed up externally of the constriction while tangential forces are effective. Because of the thinness of the known bar in its mid portion, that is, in the zone of its symmetry plane, risks of breakage are very high. If, in order to lessen such risks, the constriction is formed by a flatter configuration of the recess and thus the thickness of the impact bar is increased at the constriction, a firm holding of the impact bar against the high centrifugal forces acting in a radially outward direction is no longer sufficiently ensured.

SUMMARY OF THE INVENTION

It is an object of the invention to provide an improved impact bar of the above-outlined type which is, to a great measure, safe from breakage and is supported against tangential and radial loads in a highly satisfactory manner.

This object and others to become apparent as the specification progresses, are accomplished by the invention, according to which, briefly stated, the constriction of the impact bar is constituted by grooves provided on the leading and trailing side thereof. Each groove flank forms holding faces adapted to take up radial forces.

While impact bars are known whose constriction is formed by grooves which are provided on the leading and trailing sides of the impact bar and which are at an inclination from the outside inwardly towards the symmetry plane and which have essentially planar support faces, such known impact bars, however, do not have a C-shaped curved configuration. Further, these known impact bars are not supported against tangential forces on their trailing side radially outwardly of the constriction and thus are insufficiently secured against such forces. Further, the known impact bars which cross-sectionally have a generally dual T-shaped configuration need a significant amount of material and therefore have a substantial weight.

It is a particular advantage of the impact bar according to the invention that it is supported in its mount in a stable manner under various loads and has a high strength while having a relatively small weight. The high strength of the impact bar according to the invention is achieved particularly in that in the zone of the constriction where the highest bending stresses appear, the latter are reduced by the fact that the trailing side, externally of the constriction, is adapted to be supported for taking up tangential forces. Further, the impact bar according to the invention is, by virtue of a favorable location of its center of gravity and the simultaneous bilateral support, fully secured against rocking motions which would normally occur in response to radial forces and which would lead to a premature wear. Further, by virtue of the favorable relationship between strength and weight, the manufacturing costs may be lowered because of savings in the quantity of the bar material.

Particularly favorable conditions may be obtained by providing that the holding faces of the impact bar are inclined to the symmetry plane from the outside towards the inside and are of substantially planar shape. By virtue of the planar design there is ensured a simple manufacture thereof as well as that of the counterfaces forming part of the rotor. This advantage is further enhanced in that the holding faces are provided on both sides of the symmetry plane at equal distances from one another and that at the outside the inclined holding faces are - apart from the conventional rounded edges - adjoined by support faces for receiving tangential forces. By providing such support faces not only on the reverse (trailing) side but also on the frontal (leading) side of the impact bar, the supporting effect against radial forces is accordingly increased. Advantageously, the support faces are larger than the holding faces and extend substantially perpendicularly to the symmetry plane of the impact bar.

By virtue of the advantageous shape of the impact bar, no difficulties are involved in designing the corresponding counterfaces on the rotor of the same size. The counter faces of the rotor which are in alignment with the inclined faces of the impact bar are correspondingly inclined. The inclination of the holding faces of the impact bar is 20°–50°, preferably 30°–40° relative to the symmetry plane.

The impact bar is further secured against tilting or rocking in response to the generated radial forces by providing that the leading side of the impact bar has a depression which extends in the length direction of the bar and which is recessed relative to the support faces. Those contours of the impact bar which are situated externally of its symmetry plane are shaped dependent upon the requirements involving the various materials to be comminuted. An additional saving in the quantities of the bar material can be achieved according to the invention by providing that the outer corners of the trailing side of the impact bar have a flattened part extending to the support faces in the longitudinal direction of the impact bar. The effect of this arrangement can be further enhanced by providing, in the flattened portion, a longitudinally extending throughgoing depression.

As a rule, the impact bar extends along the entire width (measured in the axial direction) of the rotor and is, for mounting purposes, inserted therein in an axial direction from the frontal side of the rotor. In case of rotors having significant axial dimensions, it is feasible to provide in the rotor axially side-by-side arranged impact bars.

BRIEF DESCRIPTION OF THE DRAWING

FIG. 1 is a sectional view of a preferred embodiment of the invention shown in an installed state.

FIGS. 2, 3 and 4 illustrate elevational views of three further preferred embodiments of the invention.

DESCRIPTION OF THE PREFERRED EMBODIMENTS

Turning to FIG. 1, there is illustrated a rotor 2 which forms part of an impact crusher and which securely clamps an impact bar 1 by rails 3 and 4 which extend parallel to the axis of the rotor shaft 5 and which are secured in corresponding recesses 6 of the rotor discs 7 (one shown). The recesses 6 have a plane that is perpendicular to the rotary axis and are arranged in an axial series in a uniform distribution along the axial length of the rotor 2. Each rotor disc may have, for example, four recesses 6 distributed circumferentially whereby four impact bars 1 are provided in circumferential distribution on each disc. Each rail 3 and 4 has a cross-sectionally trapezoidal projection 8 and 9, respectively, which tapers towards the impact bar 1 and which projects into respective longitudinal grooves 10 and 11 formed at the trailing side and the leading side, respectively, of the impact bar 1. The radially outer circumferential surface of the rail 4 facing the leading side of the impact bar 1 is covered by a rotor guard plate 12 which may be releasably attached to the disc 7 by a screw connection.

The impact bar 1, as viewed in cross section taken along a plane parallel to the plane of rotation of the rotor 2, has a symmetrical, approximately C-shaped curved configuration. The grooves 10 and 11 have a respective bottom face 13 and 14 which are plain and extend parallel to one another and are adjoined by lateral flanks which constitute holding faces 15 and 16 whose inclination to the symmetry plane 17 is 30°. The two holding faces 15 and the two holding faces 16 have mutually identical sizes and are situated at the same distance from the symmetry plane 17. The center of gravity 18 of the cross-sectional area of the impact bar 1 is situated on the symmetry plane 17 at the mid point of the distance between the bottom faces 13 and 14. A plane 19 containing the center of gravity 18 and oriented perpendicularly to the symmetry plane 17 at least approximately contains the rotational axis of the rotor 2. This geometrical arrangement achieves that - while taking into consideration the wear which appears during operation-no tilting moment is applied to the holding parts of the impact bar 1 in either direction and thus the impact bar 1 "sits" in the rotor 2 in a very stable manner.

The holding faces 15 and 16 are adjoined at the trailing and leading side in either direction from the respective grooves 13, 14 by support faces 20 and 21 each extending parallel to the plane 19 and perpendicularly to the symmetry plane 17. The support faces 20 situated at the trailing side of the impact bar 1 are larger than the support faces 21 at the leading side and thus the former extend further away from the symmetry plane 17. The support face 20 which in the installed state of the impact bar 1 is situated radially outwardly of the symmetry plane 17 is faced by a replaceable support bar 22 which is embedded in a complemental trough of the rail 3 and which is attached thereto by a screw connection. The support face 21 is diagonally opposite the center of gravity 18 and which is radially inwardly of the symmetry plane 17 in the installed state of the impact bar 1, is faced by a countersupport surface 23 of the rail 4. The surface 23 extends along the entire length of the rail 4 parallel to the rotor axis. By virtue of the fact that under a radial load the support bar 22 and, at the same time, the countersupport face 23 engage the respective faces of the impact bar 1, in the zone of the symmetry plane 17, that is, in the zone of the constriction of the impact bar 1 very small bending forces appear.

The support faces 21 on the leading side of the impact bar 1 are adjoined outwardly and in the longitudinal direction by depressions 24 before, in its further course, the leading side continuously projects forwardly and thus forms the C shape of the impact bar 1. The outer leading edges 25 which have a rounded portion form the crest of a wedge which in the new condition of the impact bar 1 has an angle of approximately 85°. The edges 25 project forwardly beyond the plane defined by the support faces 21. The outer faces 26 situated between the leading and trailing sides of the impact bar 1 are planar and are arranged parallel to one another. This construction results in a particularly strong impact bar for maximum loads. Between the outer faces 26 and the trailing side there is provided a chamfered flattened portion which has a depression 27. The flattened portion does not weaken the stability of the impact bar to any appreciable extent.

Turning now to FIG. 2, there is shown another preferred embodiment of the impact bar according to the invention, designated at 1'. The impact bar 1' differs from the impact bar 1 merely in that the outer faces 26' do not extend in a plane-parallel manner to one another but-apart from a small flat part which adjoins the outer leading edge 25 - are convergent towards the trailing side of the impact bar. In this manner, the angle of the wedge of the impact bar which delivers blows to the material to be comminuted is reduced which leads to a saving of material for the impact bar. A further material economy is achieved in the embodiment illustrated in FIG. 3 wherein the impact bar, designated at 1", differ from the impact bar 1' shown in FIG. 2 in that its support faces 20' on the trailing side are inclined outwardly towards the leading side. The angle of inclination to the perpendicular plane 19 is approximately 15°.

Turning now to FIG. 4, there is shown still another preferred embodiment of the invention. The impact bar shown therein is designated at 1''' which, similarly to the impact bar 1" of FIG. 3 has support faces 20' which are at an inclination towards the leading side and which have at the leading side depressions 24'. The latter, in contradistinction to the impact bars of the other preferrred embodiments, are not recessed backwardly relative to the support faces 21. Between their outer faces 26' which converge towards the trailing side of the impact bar and the support faces 20' at the trailing side there is provided, on each side of the symmetry plane 17, a flattened chamfer 28.

The features of the described embodiments may be, if expedient in individual cases, combined with one another in a desired manner. The impact bars need only be machined on their support and engagement faces. For taking up shearing forces which are effective parallel to the rotor axis, the impact bars may be provided conventionally with recesses which preferably start at the bottom face 13 at the trailing side.

All appropriate friction resistant materials which may undergo bending stresses may be considered as materials for the impact bars. As a rule, cast steel with high content of chromium and nickel has been found particularly advantageous. Because of the high stability of the impact bar according to the invention as concerns bending stresses, in applications where lesser loads are expected, less expensive materials of smaller bending resistance may be used.

The impact bars according to the invention are usable practically for any type of comminution of all stone types and they find particularly advantageous use as crushers for hard rocks such as basalt, diabase, granite and gravel.

The present disclosure relates to subject matter contained in Federal Republic of Germany Patent Application No. P 35 25 442.4 (filed July 17, 1985) which is incorporated herein by reference.

It will be understood that the above description of the present invention is susceptible to various modifications, changes and adaptations, and the same are intended to be comprehended within the meaning and range of equivalents of the appended claims.

What is claimed is:

1. In an impact bar adapted to assume an installed state in a rotor of a comminuting machine; the rotor having a rotary axis, a plane of rotation and a direction of rotation; the impact bar having a length extending generally radially as viewed relative to said rotary axis in said installed state, a leading side and a trailing side as viewed relative to said direction of rotation in said installed state, and a cross-sectional area taken along a sectional plane extending parallel to said plane of rotation as viewed in said installed state; said cross-sectional area being curved in a generally C shape open towards said leading side and being symmetrically relative to a symmetry plane being generally perpendicular to said length; said cross-sectional area having a constriction lying in said symmetry plane; said trailing side being adapted to be supported against tangential forces at a location situated radially outwardly of said constriction as viewed relative to said rotary axis in said installed state; the improvement wherein said constriction is formed by a first and a second groove at said leading side and said trailing side; each groove being cross-sectionally symmetrical to said symmetry plane and each having a groove bottom and lateral groove flanks constituting holding faces for taking up forces oriented generally radially as viewed relative to said rotary axis in said installed state.

2. An impact bar as defined in claim 1, wherein the holding faces of each said groove are at identical distances from said symmetry plane.

3. An impact bar as defined in claim 1, wherein said leading side comprises outer terminal edges, each being formed by converging impact bar faces arranged at an acute angle related to said cross-sectional area.

4. An impact bar as defined in claim 1, wherein the groove bottoms of the grooves on the leading and trailing sides are planar and extend parallel to one another.

5. An impact bar as defined in claim 1, wherein said holding faces of each groove are substantially planar and are inclined towards said symmetry plane in a direction of the groove bottom.

6. An impact bar as defined in claim 5, wherein an angle of inclination defined between each said holding face and said symmetry plane is 20°–50°.

7. An impact bar as defined in claim 6, wherein said angle is 30°–40°.

8. An impact bar as defined in claim 1, further comprising support faces located on said leading and trailing sides and adjoining each said holding face of each groove externally thereof for taking up tangential forces parallel to said plane of rotation and said symmetry; each said support face being substantially parallel to said sectional plane and perpendicular to said symmetry plane.

9. An impact bar as defined in claim 8, wherein said support faces have a larger area than said holding faces.

10. An impact bar as defined in claim 8, further comprising depressions provided in said leading side adjacent said support faces; said depressions extending in a direction of said length.

11. An impact bar as defined in claim 8, wherein said support faces at said leading side are perpendicular to said symmetry plane.

12. An impact bar as defined in claim 11, wherein said support faces at said trailing side are perpendicular to said symmetry plane.

13. An impact bar as defined in claim 8, wherein said trailing side has opposite outer corners each having a flattened portion extending in a direction of said length to respective said support faces on said trailing side.

14. An impact bar as defined in claim 13, wherein said flattened portions have a depression extending in a direction of said length.

15. An impact bar as defined in claim 8, wherein said support faces on said trailing side are inclined towards said leading side as viewed from the groove on said trailing side.

16. An impact bar as defined in claim 15, wherein an angle of inclination of each said support face to a plane perpendicular to said symmetry plane is 5°–30°.

17. An impact bar as defined in claim 16, wherein said angle of inclination is 10°–20°.

18. An impact bar as defined in claim 10, wherein each said depression is recessed with respect to an adjacent said support face.

* * * * *